US009617959B2

(12) United States Patent
Kuwato et al.

(10) Patent No.: US 9,617,959 B2
(45) Date of Patent: Apr. 11, 2017

(54) PORTABLE ENGINE

(71) Applicant: Fuji Jukogyo Kabushiki Kaisha, Tokyo (JP)

(72) Inventors: Makoto Kuwato, Tokyo (JP); Kentaro Hirota, Tokyo (JP)

(73) Assignee: FUJI JUKOGYO KABUSHIKI KAISHA, Tokyo (JP)

( * ) Notice: Subject to any disclaimer, the term of this patent is extended or adjusted under 35 U.S.C. 154(b) by 140 days.

(21) Appl. No.: 14/255,727

(22) Filed: Apr. 17, 2014

(65) Prior Publication Data

US 2014/0318502 A1 Oct. 30, 2014

(30) Foreign Application Priority Data

Apr. 30, 2013 (JP) ..... 2013-094885

(51) Int. Cl.

| | |
|---|---|
| ***F02B 43/08*** | (2006.01) |
| ***F02M 37/04*** | (2006.01) |
| ***F02M 37/00*** | (2006.01) |
| ***F02B 63/02*** | (2006.01) |
| *F02B 77/13* | (2006.01) |

(52) U.S. Cl.

CPC ..... *F02M 37/0017* (2013.01); *F02B 63/02* (2013.01); *F02B 77/13* (2013.01); *F02M 37/007* (2013.01)

(58) Field of Classification Search

CPC .. F02M 25/0726; F02M 55/025; F01N 3/206; F02B 63/06

USPC ..... 123/495, 3

See application file for complete search history.

(56) References Cited

U.S. PATENT DOCUMENTS

| | | | | |
|---|---|---|---|---|
| 5,744,940 | A * | 4/1998 | Colton | F02B 63/04 123/2 |
| 8,291,587 | B2 * | 10/2012 | St. Mary | F02B 37/00 123/3 |
| 2003/0183180 | A1 * | 10/2003 | Wada | F02B 63/04 123/2 |

FOREIGN PATENT DOCUMENTS

| | | | |
|---|---|---|---|
| JP | S 55-012040 | U | 1/1980 |
| JP | S 56-159662 | U | 4/1980 |
| JP | 56-57960 | U | 5/1981 |
| JP | S 56-159662 | U | 11/1981 |
| JP | S 59-110347 | U | 7/1984 |
| JP | S 60-73871 | U | 5/1985 |
| JP | S 62-116162 | U | 7/1987 |
| JP | H 02-132821 | U | 11/1990 |
| JP | H 04-042207 | U | 4/1992 |

(Continued)

OTHER PUBLICATIONS

JPO Decision to Grant dated Sep. 29, 2015.

(Continued)

*Primary Examiner* — Lindsay Low
*Assistant Examiner* — Syed O Hasan
(74) *Attorney, Agent, or Firm* — McGinn IP Law Group, PLLC.

(57) ABSTRACT

A portable engine includes: an internal combustion engine to burn fuel so as to output power; a fuel tank to store the fuel; a fuel pump to transfer the fuel from the fuel tank to the internal combustion engine; a U-shaped fuel pipe to transfer the fuel is disposed, and at a lowest portion of a fuel passage of the fuel pipe; and a fuel drainer capable of discharging the fuel in the fuel pipe to outside. The U-shaped fuel pipe is disposed between the fuel tank and the fuel pump, and the fuel drainer is disposed at a lowest site of a fuel passage of the fuel pipe.

15 Claims, 6 Drawing Sheets

(56) References Cited

FOREIGN PATENT DOCUMENTS

| | | | | |
|---|---|---|---|---|
| JP | H 06-330829 | A | | 11/1994 |
| JP | H 08-319812 | A | | 12/1996 |
| JP | H 11-190220 | A | | 7/1999 |
| JP | 2001-027128 | A | | 1/2001 |
| JP | 2003-049664 | A | | 2/2003 |
| JP | 2005105838 | | * | 4/2005 |
| JP | 2006-009809 | A | | 1/2006 |
| JP | 2006-291769 | A | | 10/2006 |

OTHER PUBLICATIONS

JPO Notification of Refusal dated Mar. 10, 2015.
Japanese Office Action dated Mar. 1, 2016 with an English Translation.

* cited by examiner

PORTABLE ENGINE

CROSS-REFERENCE TO RELATED APPLICATIONS

The present application claims priority from Japanese Patent Application No. 2013-094885, filed on Apr. 30, 2013, the entire contents of which are hereby incorporated by reference.

BACKGROUND

1. Technical Field

The present invention relates to a portable engine provided with a fuel tank, and in particular, relates to a technique suitably applied to a fuel drainer of a portable engine generator housed in a soundproof case.

2. Related Art

A portable engine generator is used for outdoor activities with no power supply available in the vicinity. The portable engine generator is used in various ways, and a portable engine generator used for ensuring a power supply in an emergency or an outdoor leisure, for example, may often be stored unused for relatively a long period of time. When the portable engine generator is stored for such a long period of time, it is recommended to extract fuel in a fuel tank to outside to prevent malfunction in a fuel system due to deterioration in quality of gasoline.

A conventional engine generator is not provided with a dedicated structure for extracting fuel in a fuel tank, and therefore, the fuel is extracted with a kerosene pump after removing a cap on a fuel injection opening of the tank or the engine is driven needlessly until there is no more fuel in the fuel tank.

However, it may be not possible to extract the fuel remaining on the bottom with a kerosene pump if the shape of the tank is complicated and it is needed to operate the kerosene pump for many times, and hence the operation is troublesome. On the other hand, driving an engine needlessly until there is no more fuel in the fuel tank is not preferable because an unnecessary cost burden is imposed on a user and carbon oxide, which is possibly resulting in a cause of global warming, is generated.

There are proposed a technique relating to an engine provided with a fuel extracting apparatus for extracting fuel, and an invention relating to an engine generator provided with a fuel cock between a fuel pump for transferring fuel from a fuel tank to an engine and the fuel tank (see Japanese Unexamined Utility Model (Registration) Application Publication (JP-UM-A) No. S56-57960, and Japanese Unexamined Patent Application Publication (JP-A) No. 2001-27128, for example).

However, the fuel extracting apparatus according to JP-UM-A No. S56-57960 is designed to extract the fuel in a vaporizer, and thus, it cannot extract the fuel in the fuel tank.

Further, although the engine generator provided with a fuel cock described in JP-A No. 2001-27128 can prevent fuel from flowing into a cylinder from a fuel tank while carried it is not possible to extract the fuel in the fuel tank to outside.

SUMMARY OF THE INVENTION

The present invention has been achieved in view of the above-described problems, and it is an object thereof to provide a portable engine capable of easily extracting fuel in a fuel tank to outside.

To achieve the aforementioned object, an aspect of the present invention provides a portable engine including: an internal combustion engine to burn fuel so as to output power; a fuel tank to store the fuel; a fuel pump to transfer the fuel from the fuel tank to the internal combustion engine; a U-shaped fuel pipe to transfer the fuel; and a fuel drainer; and a fuel drainer capable of discharging the fuel in the fuel pipe to outside. The U-shaped fuel pipe is disposed between the fuel tank and the fuel pump.

The fuel drainer may include: a drain pipe communicated to the lowest portion of the fuel passage of the fuel pipe; a cock capable of switching a channel through which the fuel in the fuel pipe flows between the fuel passage side and the drain pipe side; and an operating unit capable of operating the cock from outside. The drain pipe may protrude downwardly.

The portable engine may include a soundproof case to cover the internal combustion engine, the fuel tank, and the fuel pump from four directions. An opening may be provided at a portion on a bottom wall of the soundproof case, the portion facing a lower end of the drain pipe.

A cross section of the bottom wall of the soundproof case may be of waveform, the waveform having the opening at the peak. The fuel drainer may be disposed so that the lower end of the drain pipe is positioned inside the opening.

The soundproof case may have an opening on a lateral wall, a cover member may be attached removably to the opening, and at least the operating unit may be disposed internally of an edge of the opening to which the cover member is attached.

The fuel drainer may include an attaching unit. The attaching unit may be securable to an inner surface side of an edge of the opening of the soundproof case. On an outer surface of the edge of the opening, a pictogram indicating a method of operating the operating unit may be three-dimensionally described.

The distal end surface of operating unit may have a groove to engage a distal end of a flat-bladed screwdriver. The distal end surface of the operating unit may be positioned, as viewed from the surface of the attaching unit, internally of the case.

BRIEF DESCRIPTION OF THE DRAWINGS

FIG. 1A is a perspective view illustrating a state where a side cover is attached, and FIG. 1B is a perspective view illustrating a state where the side cover is removed.

DETAILED DESCRIPTION

With reference to the drawings, one implementation of the present invention will be described in detail below.

Figure 1A:
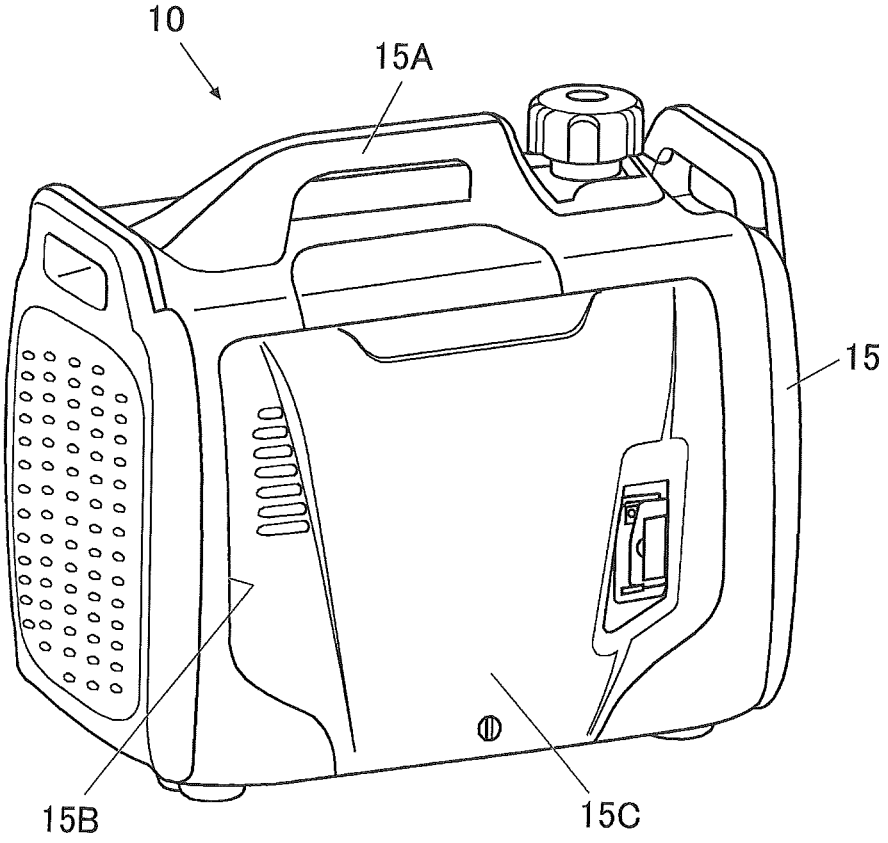
FIGS. 1A and 1B illustrate an overview of a portable engine according to an implementation of the present invention.
Figure 1B:
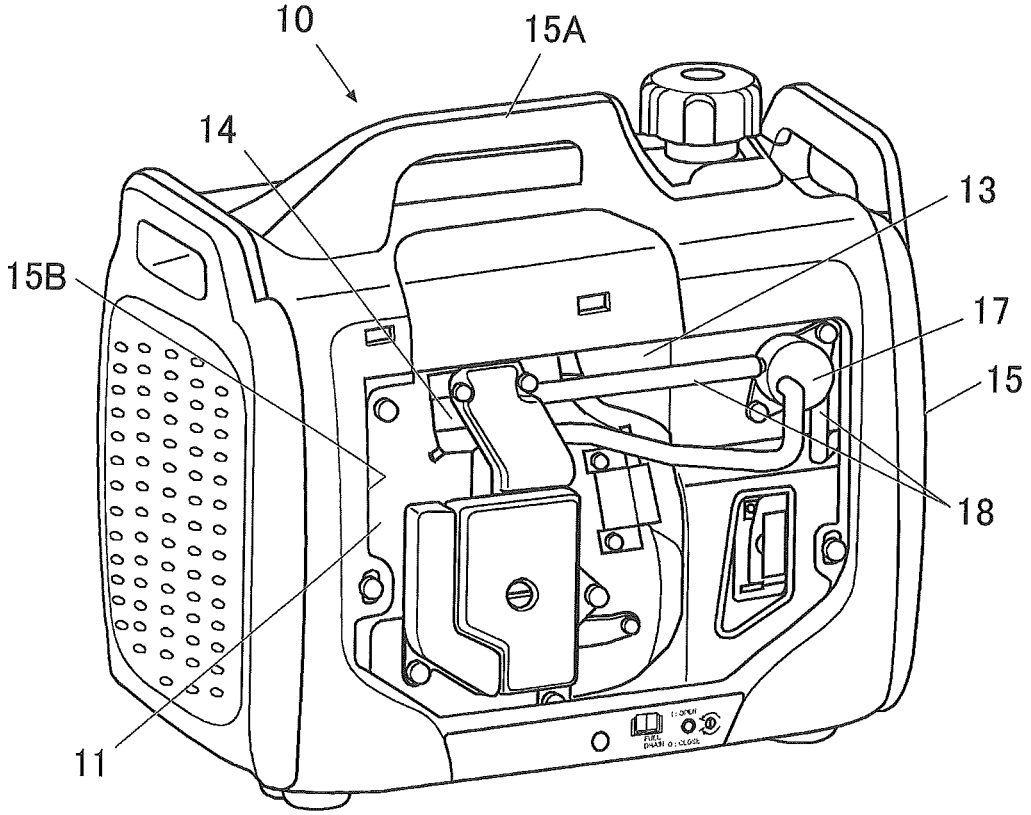

FIGS. 1A and 1B illustrate an overview of a portable engine generator which is an example of an engine to which the present invention is suitably applied. FIG. 1A is a perspective view illustrating a state where a side cover is attached, and FIG. 1B is a perspective view illustrating a state where the side cover is removed.

As illustrated in FIG. 1B, a portable engine generator 10 according to the present implementation includes an internal combustion engine 11 (hereinafter, referred to as "engine main body") such as an air-cooled gasoline engine, and a generator (not illustrated) that is rotationally driven by the engine main body 11 to generate power. Further, the engine generator 10 includes: a fuel tank 13 to store fuel such as gasoline supplied to the engine main body 11; and a carburetor (vaporizer) 14 to vaporize the fuel supplied to the engine. A box-shaped soundproof case 15 houses and covers these components.

The soundproof case 15 has a grip part 15A at the upper part, and an opening 15B at the lateral side. The opening 15B facilitates maintenance work such as an inspection or a repair of the carburetor 14 and a spark plug. The soundproof case 15 also has a cover 15C capable of blocking the opening 15B. The cover 15C is removably secured to the soundproof case 15.

Although not particularly limited, in the engine generator 10 according to the present implementation, the engine main body 11 is disposed at a substantially center inside the soundproof case 15, such that a cylinder head is positioned at an upper part of the engine main body 11. Further, at a lower part of the engine main body 11, a crank shaft (not illustrated) is disposed substantially horizontally in the right-to-left direction of FIG. 1B. For the sake of convenience, the right side of FIG. 1 is defined as "front" and the left side of FIG. 1 is defined as "rear".

A generator (not illustrated) is attached at a front side of the crank shaft at the lower part of the engine main body 11, and a recoil starter and a cooling fan (not illustrated) are attached at a farther front side. Further, the fuel tank 13 is disposed above the generator (not illustrated), and a muffler (not illustrated) is disposed at a rear side of the engine main body 11.

A fuel pump 17 is disposed above the recoil starter and the cooling fan and in the vicinity of the fuel tank 13 inside the soundproof case 15. The fuel pump 17 supplies the engine main body 11 with fuel. The carburetor 14 is disposed at the rear (left side in FIG. 1) of the fuel tank 17. A fuel pipe 18 (see FIG. 2) is disposed below the fuel tank 13 and the fuel pump 17. The fuel is transferred from the fuel tank 13 to the fuel pump 17 through the fuel pipe 18. A start end of the fuel pipe 18 is connected to the bottom of the fuel tank 13 and a terminal end thereof is connected with the fuel pump 17.

Figure 2:
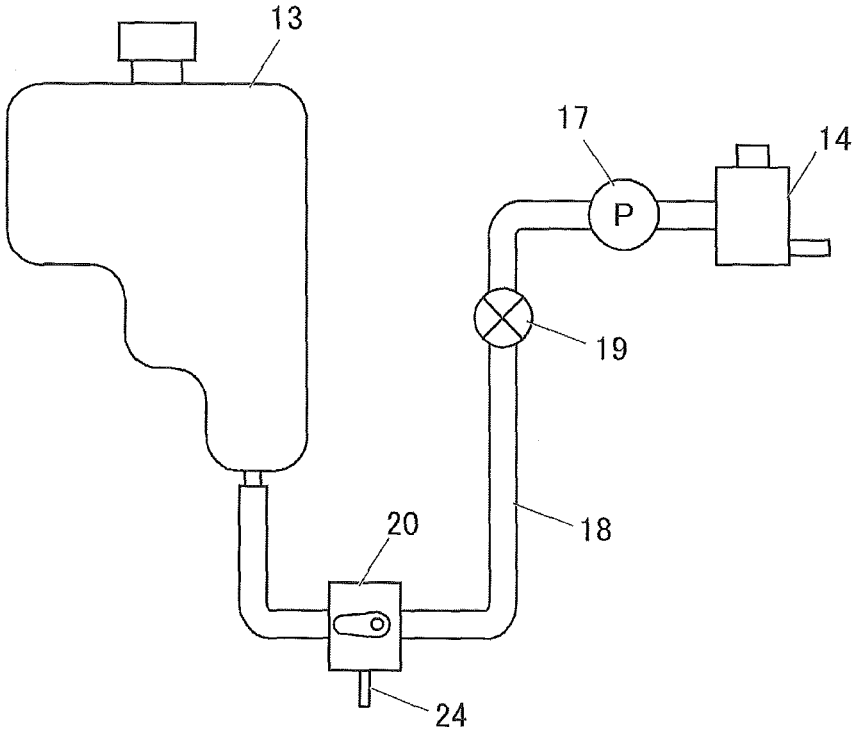
FIG. 2 is a schematic configuration diagram illustrating a relationship between a fuel tank and a fuel pump, and a fuel pipe.

In the engine generator 10 of the present implementation, the shape of the fuel tank 13 and arrangement of each constituent component are decided such that unnecessary space is generated to achieve reduction in size of the soundproof case 15, a whole of the apparatus. For this purpose, the fuel pipe 18 is formed in "U" letter as a whole so as to detour the lower part of the generator (not illustrated). As illustrated in FIG. 1B, even when the cover 15C is removed from the soundproof case 15, the fuel pipe 18 is not easily seen from the opening 15B. FIG. 2 illustrates a schematic configuration diagram to indicate a relationship among the fuel tank 13 and the fuel pump 17, and the fuel pipe 18.

As illustrated in FIG. 2, the entire shape of the fuel pipe 18 substantially is formed like the "U" letter. A fuel drainer 20 to flow the fuel downward is disposed at the lowest location of the U-shaped fuel pipe 18. The carburetor (vaporizer) 14 is disposed beyond (downstream of) the fuel pomp 17, and an opening-and-closing cock 19 is disposed at a portion near the fuel pump 17 of the fuel pipe 18. When the engine generator 10 is carried, the opening-and-closing cock 19 is closed so that it is possible to prevent the fuel in the fuel tank 13 from flowing in the carburetor 14 via the fuel pipe 18 while the fuel pump 17 is stopped.

Figure 3:
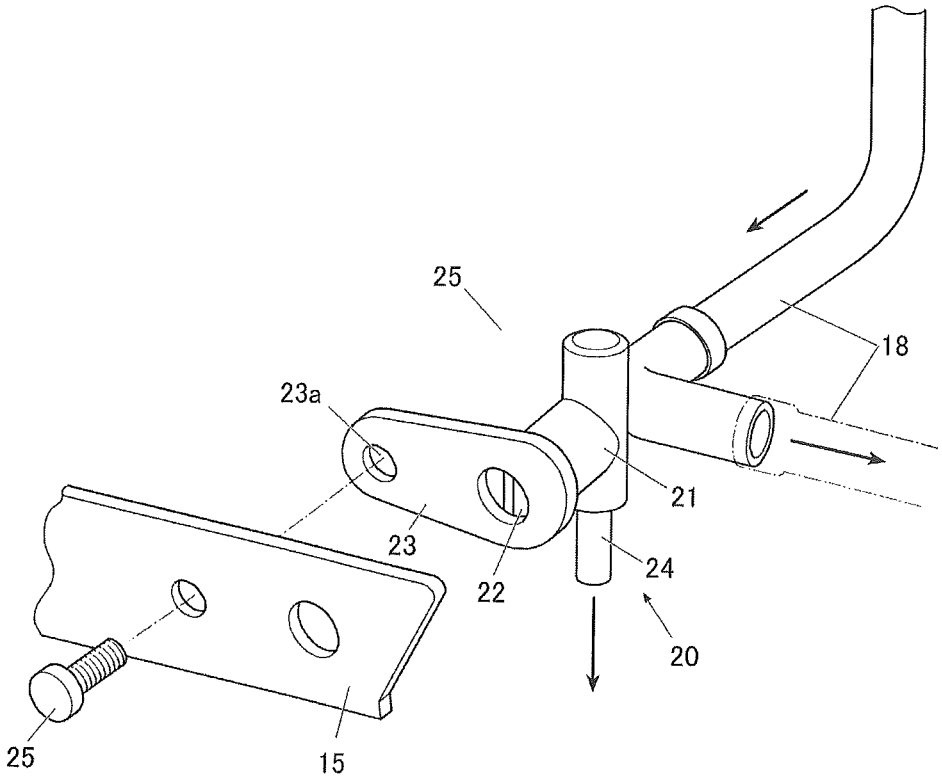
FIG. 3 is an enlarged perspective view illustrating in detail a fuel drainer in the present implementation.

FIG. 3 illustrates an enlarged perspective view of the fuel drainer 20 in the present implementation. As illustrated in FIG. 3, the fuel pipe 18 hanged down from the fuel tank 13 is pulled out toward the opening 15B from a deeper part of the case, and then bent toward the front (right side of FIG. 2), and the fuel drainer 20 is disposed at the bent section. The fuel drainer 20 includes a drain cock 21 to switch directions into which the fuel flows, an operating unit 22 to operate the drain cock 21 from outside, and an attaching unit 23 to attach the drain cock 21 and the operating unit 22 to a wall surface of the soundproof case 15. In the present implementation, the drain cock 21 is a rotation-type lever cock, and instead of a lever, a screw (hereinafter, referred to as "cock operating screw") is used as the operating unit 22.

The fuel drainer 20 is disposed inside a lower end edge of the opening 15B covered by the cover 15C removably attached to a lateral side of the soundproof case 15. When the fuel drainer 20 is located at such a position, the fuel drainer 20, in particular, a distal end part of the cock operating screw 22 is covered by the cover 15C, when the cover 15C is attached to cover the opening 15B. As a result, it is possible to prevent an alien substance such as dust and rain from entering between the attaching unit 23 and the operating unit 22.

The cock operating screw 22 has a minus groove on the distal end surface to engage a distal end of a flat-bladed screwdriver, and the distal end surface is formed not to protrude beyond the surface of the attaching unit 23. The fuel drainer 20 includes a drain pipe 24 that configures a discharge port and protrudes downwardly. When the distal end of the flat-bladed screwdriver is engaged with the groove on the distal end surface of the cock operating screw 22, and then turned, the cock operating screw 22 rotates so as to switch between a state where the fuel in the fuel pipe 18 is flown along the original pipe and a state where the fuel is discharged from the drain pipe 24.

The attaching unit 23 has a screw hole 23*a* in which a securing screw 25 screws via a screw through-hole formed on the lateral wall inner surface of the soundproof case 15. As a result, the fuel drainer 20 is secured to the lateral surface of the bottom wall of the soundproof case 15. Specifically, a positioning hole (not illustrated) having a screw through-hole at the distal end is disposed on the lateral surface of the bottom wall of the soundproof case 15. When a positioning pin disposed in the attaching unit 23 is engaged with the positioning hole and the securing screw 25 is screwed, positioning and securing can be simultaneously performed.

Figure 4:
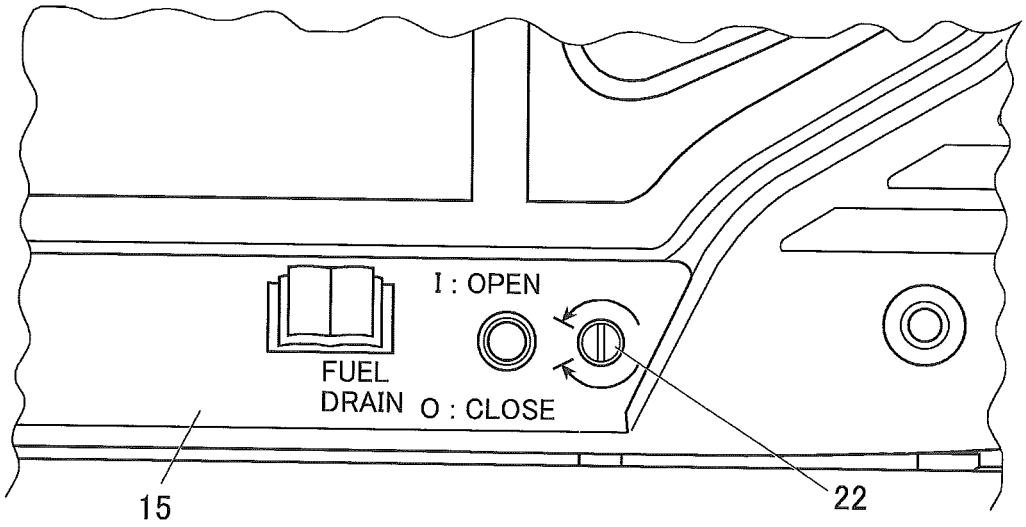
FIG. 4 is an enlarged view illustrating a notation example of clearly indicating a method of operating an operation lever.

As illustrated in FIG. 4, on the lateral surface of the bottom wall of the soundproof case 15, a pictogram and a descriptive text clearly indicating a method of operating the cock operating screw 22 are three-dimensionally provided by resin molding. The formation of such three-dimensional notation facilitates understanding of the operating method. Further, the configuration in which the cock operating screw 22 has, on the distal end surface, the minus groove to engage the distal end of a flat-bladed screwdriver, and the distal end surface is formed so as not protrude beyond the surface of the attaching unit 23 can prevent a user from erroneously operating the drain cock 21.

Figure 5:
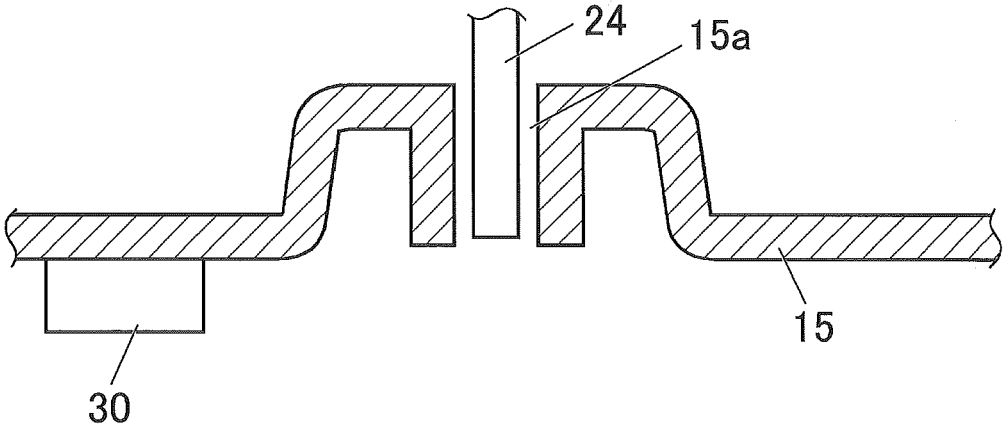
FIG. 5 is an enlarged cross-sectional view illustrating a relationship between a drain pipe and a bottom wall of a soundproof case.

Further, in the present implementation, the bottom wall of the soundproof case 15 is skillfully devised so that it is possible to ensure that the fuel flown out from the drain pipe 24 is discharged to outside the soundproof case 15. Specifically, as illustrated in FIG. 5, the bottom wall of the soundproof case 15 is of waveform, an opening 15*a* slightly larger in outer shape than the drain pipe 24 is formed at a portion corresponding to a peak of each wave, and the opening 15*a* is configured to face the distal end (lower end) of the drain pipe 24.

Even when the engine generator is installed at an inclined surface and the whole apparatus is inclined, such a structure prevents the fuel flown out from the drain pipe 24 from leaking inside the soundproof case 15 and remaining on the bottom of the case. At the same time, the position of the distal end (lower end) of the drain pipe 24 is made higher than a grounding surface of the bottom wall, whereby it is possible to make it difficult for an alien substance to enter from the distal end of the drain pipe 24.

Further, at a lower surface of the bottom wall of the soundproof case 15, a rubber pad 30 that serves also as a slip stopper is attached. As a result, the bottom wall of the soundproof case 15 seldom makes a direct contact with the grounding surface, whereby it is difficult for an alien substance such as dust or water to enter inside the case.

In the above-described implementation, the portable engine generator provided with the soundproof case is used. However, the present invention is not limited to the portable engine generator provided with the soundproof case. It is possible to apply the present invention to an engine generator lacking a soundproof case or a general-purpose engine lacking a generator, for example.

The invention claimed is:

1. A portable engine comprising:

an internal combustion engine to burn fuel so as to output power;

a fuel tank to store the fuel;

a U-shaped fuel pipe to transfer the fuel, the U-shaped fuel pipe being disposed between the fuel tank and a fuel pump; and a fuel drainer capable of discharging the fuel in the U-shaped fuel pipe to outside, the fuel drainer being disposed at a lowest site of a fuel passage of the U-shaped fuel pipe, wherein the fuel drainer comprises:

a drain pipe communicated to the lowest portion of the fuel passage of the U-shaped fuel pipe;

a cock capable of switching a channel through which the fuel in the U-shaped fuel pipe flows between a fuel passage side and a drain pipe side; and an operating unit capable of operating the cock from outside of a soundproof case covering the internal combustion engine, wherein the U-shaped fuel pipe includes a first pipe portion, a second pipe portion extending downwardly from the fuel tank, and a third pipe portion, the first pipe portion being disposed perpendicular to the second pipe portion and the third pipe portion, and wherein the fuel drainer is disposed on the first pipe portion.

2. The portable engine according to claim 1, wherein the drain pipe protrudes downwardly.

3. The portable engine according to claim 1, wherein the soundproof case covers the internal combustion engine, the fuel tank, and the fuel pump from four directions, and wherein an opening is formed at a portion on a bottom wall of the soundproof case, the portion facing a lower end of the drain pipe.

4. The portable engine according to claim 3, wherein a cross section of the bottom wall of the soundproof case is of waveform, the waveform having the opening at the peak; and the fuel drainer is disposed so that the lower end of the drain pipe is positioned inside the opening.

5. The portable engine according to claim 3, wherein the soundproof case has an opening on the lateral wall;

a cover member is attached removably to the opening; and at least the operating unit is disposed internally of an edge of the opening to which the cover member is attached.

6. The portable engine according to claim 5, wherein the fuel drainer comprises an attaching unit;

the attaching unit is securable to an inner surface side of an edge of the opening of the soundproof case; and on an outer surface of the edge of the opening, a pictogram indicating a method of operating the operating unit is three-dimensionally described.

7. The portable engine according to claim 6, wherein the distal end surface of the operating unit has a groove to engage a distal end of a flat-bladed screwdriver; and the distal end surface of the operating unit is positioned, as viewed from the surface of the attaching unit, internally of the soundproof case.

8. The portable engine according to claim 2, wherein the soundproof case covers the internal combustion engine, the fuel tank, and the fuel pump from four directions, and wherein an opening is formed at a portion on a bottom wall of the soundproof case, the portion facing a lower end of the drain pipe.

9. The portable engine according to claim 2, wherein the soundproof case has an opening on the lateral wall;

a cover member is attached removably to the opening; and at least the operating unit is disposed internally of an edge of the opening to which the cover member is attached.

10. The portable engine according to claim 8, wherein a cross section of the bottom wall of the soundproof case is of waveform, the waveform having the opening at the peak; and the fuel drainer is disposed so that the lower end of the drain pipe is positioned inside the opening.

11. The portable engine according to claim 10, wherein the fuel drainer comprises an attaching unit;

the attaching unit is securable to an inner surface side of an edge of the opening of the soundproof case; and on an outer surface of the edge of the opening, a pictogram indicating a method of operating the operating unit is three-dimensionally described.

12. The portable engine according to claim 11, wherein the distal end surface of the operating unit has a groove to engage a distal end of a flat-bladed screwdriver; and the distal end surface of the operating unit is positioned, as viewed from the surface of the attaching unit, internally of the soundproof case.

13. The portable engine according to claim 1, wherein the soundproof case covers the internal combustion engine, the fuel tank, and the fuel pump from four directions, and wherein the drain pipe protrudes outside of the soundproof case.

14. The portable engine according to claim 1, wherein the fuel drainer functions other than filtering fuel.

15. The portable engine according to claim 1, wherein the fuel drainer is disposed inside a lower end edge of a cover member attached to a lateral side of the soundproof case so as to prevent an entrance of a substance between the cover member and the soundproof case.

* * * * *